US006537743B2

(12) United States Patent
Motokui et al.

(10) Patent No.: US 6,537,743 B2
(45) Date of Patent: Mar. 25, 2003

(54) THERMALLY DEVELOPABLE SILVER HALIDE PHOTOTHERMOGRAPHIC MATERIAL

(75) Inventors: Yasuyuki Motokui, Hino (JP); Kenji Ohnuma, Hino (JP); Hidetoshi Ezure, Hino (JP); Takayuki Sasaki, Hino (JP); Ichiro Kudo, Hino (JP)

(73) Assignee: Konica Corporation (JP)

( * ) Notice: Subject to any disclaimer, the term of this patent is extended or adjusted under 35 U.S.C. 154(b) by 0 days.

(21) Appl. No.: 10/017,604

(22) Filed: Dec. 7, 2001

(65) Prior Publication Data

US 2002/0132197 A1 Sep. 19, 2002

(30) Foreign Application Priority Data

Dec. 20, 2000 (JP) ..... 2000-386937

(51) Int. Cl.[7] ..... G03C 1/498; G03C 1/76

(52) U.S. Cl. ..... 430/619; 430/531; 430/533; 430/950

(58) Field of Search ..... 430/619, 531, 430/496, 950, 533

(56) References Cited

U.S. PATENT DOCUMENTS 5,288,826 A * 2/1994 Yamamoto et al. ..... 526/279
6,110,659 A * 8/2000 Hatakeyama et al. ..... 430/617
6,413,705 B1 * 7/2002 Fujikura et al. ..... 430/496

* cited by examiner

*Primary Examiner*—Thorl Chea
(74) *Attorney, Agent, or Firm*—Bierman, Muserlian and Lucas

(57) ABSTRACT

An silver halide photothermographic light sensitive material comprising a support having thereon a undercoating layer and a photographic light-sensitive layer containing a light-sensitive silver halide, and organic silver salt, a reducing agent and a binder, wherein the undercoating layer contains fine particles having a mean primary particle size of 0.01 to 1.6 $\mu$m and satisfying the following equation, $$1 \leqq (r2/r1) \leqq 1.4$$

Figure 1:
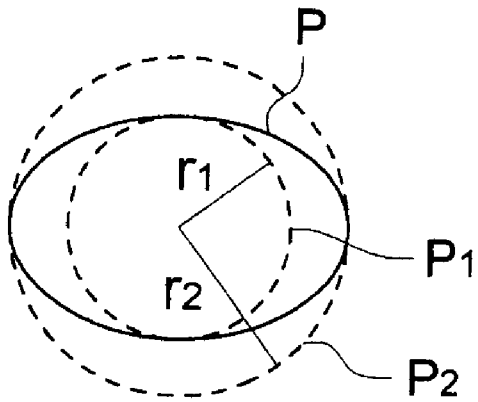

wherein $r_1$ and $r_2$ are respectively an inscribed circle radius and a circumscribed circle radius of each of projected images of the fine particles obtained by a microscope, and $(r_2/r_1)$ is an average value of $r_2/r_1$ of projected images of 500 fine particles randomly selected from the whole fine particles.

6 Claims, 1 Drawing Sheet

THERMALLY DEVELOPABLE SILVER HALIDE PHOTOTHERMOGRAPHIC MATERIAL

FIELD OF THE INVENTION

The present invention relates to a silver halide photothermographic light-sensitive material and in particular to a silver halide photothermographic light-sensitive material (hereinafter, also referred to as a silver halide photothermographic material or simply as photothermographic material) having minimal flaws and coating defects in its undercoating layer.

BACKGROUND OF THE INVENTION

Recently, the wet development process of photographic material, which has been widely used so far, is overcoming problems such as to reducing photographic processing effluents, with respect to a social trend of strong requirement for environmental care. Attempts to minimize the amount of processing effluents have been made, for example, by reducing replenishing rates, solidifying processing chemicals or recycling processing solutions. Silver halide photothermographic materials, which can adapt to dry processing rather than wet processing, have been developed under the foregoing circumstance. A silver halide photothermographic material called "Dry Silver" including a silver halide, reducing agent and silver salt of a fatty acid is coming to be used in some areas of photographic materials, because of using no liquid and producing no waste.

The foregoing silver halide photothermographic material can be developed by heating at 80 to 140° C. after exposure without being further subjected to any other post-processing and which is an environmentally friendly photographic material.

Silver halide photothermographic materials are expected to undergo further development due to its ease of handling, however it has been necessary to solve the problem of some defects which were not a problem in wet processing silver halide light-sensitive photographic materials. Specifically, in the case of medical X-ray silver halide light-sensitive materials, a silver halide photothermographic material free of abrasion mark, adhesion matters or the like, which may lead to misdiagnosis of an area of focus in radiography of a living organism has been required.

Extensive study by the inventors to solve the foregoing problems has revealed that some of the aforementioned shortcomings are due to characteristics of an undercoating layer. Further, it was proved that problems during the drying of the undercoating layer are related to white spot defects (whitish spots caused in a light-sensitive layer) of silver halide photothermographic materials which appear after heat development. The inventors have proved that some flaws or cut-off in the undercoating layer are produced while transporting the web after coating of the undercoating layer and the white spot defects are assumed to be produced from the results thereof: unevenness of the undercoating layer; minute protrusions of the support produced before the coating of the silver halide photothermographic light-sensitive layer due to the winding pressure after the undercoated support has been wound up; transfer of matter dropped off from the undercoating layer and the like; or uneven surface of the photographic material produced after coating of the silver halide photothermographic light-sensitive layer. Factors causing no problem in wet processable conventional silver halide photographic light-sensitive materials may cause aforementioned troubles in case of silver halide photothermographic materials. There has been strongly desired development of a technique for improving such defects in silver halide photothermographic materials.

SUMMARY OF THE INVENTION

Accordingly, it is an object of the invention to provide a silver halide photothermographic material, in which the undercoating layer is resistant to abrasion and produces no dropped-off matter, nor causing staining in the coating process, thereby minimizing white spotting defects. The white spots referred in the invention are portions where the silver halide light-sensitive layer becomes thinner, producing a fine portion giving a lower image density relative to the surrounding normal portion.

The inventors have found that fine particles such as a matting agent used in an undercoating layer may collapse or drop off when the support web is coated with an undercoating layer and then transported by the rolls, which produces a dug hole, sticks to the undercoating layer or scratches the undercoating layer again, and these kinds of defects result in white spotting defects or abrasion marks. Therefore the inventors have found fine particles to be more suitable for photothermographic materials, and have succeeded in developing a photothermographic material including the undercoating layer using these fine particles.

The invention comprises the following structures.

Structure 1:

A silver halide photothermographic light sensitive material comprising a support having thereon an undercoating layer and a light-sensitive layer containing a light-sensitive silver halide, an organic silver salt, a reducing agent and a binder, wherein the undercoating layer contains fine particles having a mean primary particle size of 0.01 to 1.6 $\mu$m and satisfying the following equation:

$$1 \leqq (r_2/r_1) \leqq 1.4$$

wherein $r_1$ and $r_2$ are respectively an inscribed circle radius and a circumscribed circle radius of each of projected images of the fine particles obtained by a microscope, and $(r_2/r_1)$ is an average value of $r_2/r_1$ of 500 projected image of the fine particles randomly selected from the whole fine particles.

Structure 2:

The silver halide photothermographic light-sensitive material of Structure 1, wherein the undercoating layer contains the fine particles of 10 to 100 in an area of 100 $\mu$m square and has a center-line mean roughness (Ra) of not more than 0.015 nm.

Structure 3:

The silver halide photothermographic light-sensitive material of Structure 1, wherein the fine particles have a variation coefficient of primary particle size of not more than 0.25.

Structure 4:

The silver halide photothermographic light-sensitive material of Structure 1, wherein the fine particles are inorganic fine particles having a surface modified with an alkoxide.

Structure 5:

The silver halide photothermographic light-sensitive material of Structure 1, wherein the fine particles are non-porous.

Structure 6:

The silver halide photothermographic material of Structure 1, wherein the undercoating layer contains a hydrophilic polyester resin.

BRIEF OF THE DRAWINGS

FIG. 1 illustrates a magnified view of a fine particle in the undercoating layer and circles inscribing and circumscribing the particle.

DETAILED DESCRIPTION OF THE INVENTION

The present invention will be further detailed below. The silver halide photothermographic material of the invention comprises at least one undercoating layer on at least one side of a support, and the undercoating layer contains the fine particles relating to the invention.

First, a support used in the invention will be described. The support used for the silver halide photothermographic material according to the invention is preferably a liner polyester obtained by condensation polymerization of a glycol and a dicarboxylic acid; examples of the dicarboxylic acid include terephthalic acid, naphthalenedicarboxylic acid, iso-phthalic acid, phthalic acid, adipic acid and sebacic acid; and examples of the glycol include ethylene glycol, trimethylene glycol, tetramethylene glycol and cyclohexane dimethanol. Specifically, polyesters comprising terephthalic acid, 2,6-naphthalene dicarboxylic acid, 1,4-naphthalenedicarboxilic acid, 1,5-naphthalenedicarboxylic acid or 1,4-cyclohexane dicarboxylicacid as a dicarboxylic acid and ethylene glycol, butylene glycol or cyclohexane dimethanol as a glycol are preferably used. Exemplarily, polyethylene terephthalate, poly-1,4-cyclohexylenedimethylene terephthalate and polyethylene 2,6-naphthalenedicarboxylate are specifically preferable as a support of the invention. Further a fused mixture of different molecular weight polymers of a polyester selected from ones described above or the fused mixture of two or more different polyesters selected from ones described above may be used. A copolymerization product of a polyethylene terephthalic acid component and other polyester component is also preferable. The polyester support useful for the invention is preferably provided with superior characteristics in such as dimensional stability against heat and humidity, heat-resistance, chemical resistance, transparency and mechanical strength, and free of deformation or dimension variation at heating temperatures of the heat development.

The support relating to the invention may contain fine particles such as calcium carbonate, amorphous zeolite particles, anatase-type titanium dioxide, calcium phosphate, silica, kaolin, talk and clay to provide a little slipping ability, and the addition amount thereof is preferably 0.0005 to 25 parts by weight based on 100 parts by weight of the polyester composition. In addition to the fine particles, there may be incorporated fine particles precipitated by a reaction between a residual catalyst and a phosphor compound in the condensation polymerization reaction phase of the polyester. The precipitated fine particles include, for example, those composed of calcium, lithium and phosphor compounds or those composed of calcium, magnesium and phosphor compounds. The content of these fine particles in the polyester is preferably 0.05 to 1.0 parts by weight, based on 100 parts by weight of polyester. Further, various additives, such as an anti-oxidant and dyes, which are well known in the art, may be added to the polyester support.

The thickness of the polyester support is preferably 10 to 250 $\mu$m, and more preferably 15 to 200 $\mu$m.

In the invention, to reduce the roll set curl caused by keeping the polyester support wound in a roll at heated state or for a long period of time, the polyester support after casting may be subjected to an annealing treatment at a temperature below the glass transition temperature for 0.1 to 1500 hrs., as described in JP-A 51-16358 (JP-A refers to unexamined and published Japanese Patent Publication).

Next, the fine particles usable in the undercoating layer relating to the invention and the undercoating layer containing the fine particles will be explained. The silver halide photothermographic material according to the invention is preferably provided with 10 to 100 fine particles per an area of 100 $\mu$ms square (i.e., an area of 100 $\mu$m×100 $\mu$m) of the undercoating layer, and the center-line mean roughness (Ra) of the undercoating layer is preferably not more than 0.015 $\mu$m. By this structure, the surface of the coated undercoating layer exhibits very even flatness and strong resistance to scratch marks, resulting in a very few drop-off of fine particles from the undercoating layer.

FIG. 1 illustrates the inscribed and circumscribed circles of the projected image of the fine particle in the undercoating layer relating to the invention which can be obtained with an electron microscope. The fine particles used in the invention is preferably close to spherical form, and more preferably as close to spherical form as possible. In more detail, the average of the ratio of radius $r_2$ of the circumscribed circle $P_2$ to radius $r_1$ of inscribed circle $P_1$, i.e., the average value of $r_2/r_1$ is preferably within a range of 1 to 1.4, and more preferably within a range of 1 to 1.25. The average value of $r_2/r_1$ is determined according to the following procedure. Thus, 500 fine particles contained in the undercoating layer are randomly selected from electron micrographs of some ten thousands magnification, an inscribed circle of a maximum radius (i.e., a maximal circle internally touching the circumference of the particle and an circumscribed circle of a minimum radius (i.e., a minimal circle externally touching the circumference of the particle) are drawn for each of the particles, the radius ($r_1$) of the inscribed circle $P_1$ and radius ($r_2$) of circumscribed circle $P_2$ are determined and the average value of $r_2/r_1$ of the 500 particles is determined.

The fine particles used in the invention preferably have a mean primary particle size of 0.01 to 1.6 $\mu$m, more preferably 0.03 to 1.6 $\mu$m, and furthermore preferably 0.1 to 1.6 $\mu$m. The mean primary particle size of the fine particles used in the invention is determined by measuring the particle size of 500 fine particles in the electron micrograph and calculating them. In the invention, the primary particle size is a diameter of a circle whose area is equivalent to that of the particle in the electron micrograph.

Any fine particles provided with the aforementioned shape and particle size can be used in the invention without limitation of preparation methods, material quality, etc. By the use of the fine particles having these shape and mean particle size, the fine particles may not abnormally protrude from the undercoating layer, rarely causing flaws and drop-off of the fine particles.

The number of fine particles in an area of 100 $\mu$m square is determined through an optical microscope.

The aforementioned center-line mean roughness (Ra) is defined in JIS-B0601, or in ISO 468-1982, ISO 3274-1975, ISO 4287/1-1984, ISO 4287/2-1984 and ISO 4288-1985.

In more detail, it is defined as follows.

The center-line mean roughness (Ra), which is also called an arithmetic mean roughness, is a parameter representing an averaged value of surface roughness caused by protrusions (or peaks and valleys) on the surface. The higher is this value, the larger the average roughness.

The center-line mean roughness (Ra), when the roughness curve has been expressed by y=f(x), is a value, expressed in micrometer (μm), that is obtained from the following formula, extracting a part of reference length L in the direction of its center-line from the roughness curve, and taking the center-line of this extracted part as X-axis and the direction vertical magnification as Y-axis:

$$Ra=1/L|f(x)|dx$$

The center-line mean roughness (Ra) can be determined, for example, in such a manner that measuring samples are allowed to stand in an atmosphere of 25° C. and 65% RH for 24 hrs. and then measured under the same atmosphere. As a measurement apparatus is cited, for example, WYKO-3D non-contact type three-dimensional micro surface shape measuring system, available from WYKO Co.

The fine particles in the undercoating layer according to the invention preferably are monodisperse particles having a variation coefficient of primary particle size of not more than 0.25, more preferably not more than 0.20, and furthermore preferably not more than 0.15. The variation coefficient of primary particle size is a value of a standard deviation of particle size of all particles divided by the mean particle size. The particle size of the fine particles is preferably as homogeneous as possible. The particle size distribution is also determined from the electron micrograph thereof.

The fine particles useful in the undercoating layer relating to the invention may be of inorganic type or organic polymer type, and are preferable not to be deformed when being subjected to heat development at 80 to 140° C., and more preferably are inorganic fine particles.

As the inorganic fine particles usable in the undercoating layer used in the invention, those having the inorganic compound structures described in Kagaku-Daijiten 9, p.312 (4th compact-size edition, published in 1968, and by Kyoritsu Publishing Co.) can be used. Inorganic fine particles include, for example, $CaCO_3$, $CaSO_4$, ZnS, $BaSO_4$, $MgCO_3$, $CaF_2$, ZnO, $ZnCO_3$, $TiO_2$, $SnO_2$, $SiO_2$, $Al_2O_3$, etc. and the composite metal compounds thereof. Silica fine particles are, for example, prepared by forming a hydrated silica ($Si(OH)_4$) by a hydrolysis of ortho-ethyl silicate ($Si(OC_2H_5)_4$), further, converting it into hydrate monodisperse spherical particles, and then dehydrating them to cause silica bonding to three-dimensionally grow. Specifically preferable in the invention is inorganic fine particles of silica.

The fine particles used in the undercoating layer relating to the invention are preferably inorganic fine particles having a surface modified with an alkoxide. Inorganic fine particles which have been subjected to surface modification with an alcohol are useful. The inorganic fine particles surface-modified with an alkoxide are formed in such a manner that synthesis in the presence of water and an alcohol is completed and/or interrupted at the time reaching a given particle size, thereafter, the particles are kept at a relatively high temperature, e.g., ca. 300° at a time in the drying process. Alternatively, after completion of the particle formation, an alcohol is added thereto and the particles may be treated at a temperature of approximately 300° C. Thus, the fine particles usable in the invention are inorganic fine particles formed in wet process and having residual alcohol on the surface after the particle formation. Examples of fine particles commercially available as a matting agents include Seahoster KE-P50, KE-P20, KE-P30, KE-40, KE-50, KE-P70, KE-80, KE-90, KE-100 and KE-P150 (all are produced by Nippon Shokubai Ltd., Co.). Further, they also include Seahoster KE-E20, KE-E30, KE-E40, KE-E50, KE-E70, KE-E80, KE-E90 and KE-E150 (all are produced by Nippon Shokubai Ltd., Co.). Examples of the alcohol includes methanol, ethanol, propanol, butanol, amyl alcohol, benzyl alcohol and ethyleneglycol; of these, methanol and ethanol are preferred and methanol is more preferred.

In the invention, the aforementioned inorganic fine particles (described in the above-cited Kagaku-Daijiten), may be those subjected to a surface treatment so as to cause methyl, ethyl, propyl radicals, etc. to be present on the particle surface; those subjected to a surface treatment using a coupling agent such as tetramethylsilane, tetraethylsilane, tetrapropylsilane and the partially hydrolyzed compounds thereof; and those subjected to a surface treatment by such as the methyl radical, octylsilane and trimethylsilyl radical. Further the surface may be chemically modified so as to cause hydrophobic radicals to be present on their surface. During the preparation of the fine particles, a minute amount of a catalyst and the like may be adsorbed or bonded onto the particle surface. The organic compounds as the processing agents are not specifically limited for the surface treatment.

The fine particles used in the undercoating layer relating to the present invention are preferably non-porous. Any fine non-porous particles can be used without any limitation, however, they are preferably selected from the fine particles exhibiting an interaction with a binder used and further having low water absorbing property. The fine particles preferably are those which are hardly coagulated even when they may drop off or collapse during the transportation of the web. To achieve the desired particle size useful for the invention, preparation methods of fine particles well known in the art can also be applied, and the desired mean particle size and size distribution can be controlled by subjecting the fine particles to such as a grinding treatment and classification process. Further, porous and non-porous fine particles can be prepared by the method well known in the art such as those described in JP-A 52-52876.

Preferred examples of the fine particles used in the invention also include organic polymer matting agents and specifically cross-linking polymer matting agents. Any cross-linking polymer matting agent that has high elasticity and is hardly collapsed can be used without limitation, however, harder one is preferred. They include, for example, a co-polymer of methyl methacrylate (main component), alkylacrylate and ethylene glycol diacrylate; and a co-polymer of styrene (main component), alkyl acrylate and divinyl benzene.

Next, the undercoating layer in the invention will be explained. The undercoating layer, which is also generally referred to as a substratum, sub layer or a subbing layer, is a thin layer coated on the surface of a support to enhance adhesion property between the support and other layer. According to the invention, the undercoating layer is present between the support and a silver halide photothermographic light-sensitive layer or between the support and a back-coating layer, and is coated on at least one of the silver halide photothermographic light-sensitive layer side or the back-coating layer side of the support. The undercoating layer of the invention may be composed of multiple layers.

The undercoating layer used in the invention preferably contains a hydrophilic polyester resin. A hydrophilic polyester resin is substantially a linear polyester which is obtained by a condensation polymerization of a dibasic acid or its derivative capable of esterification and a glycol or its derivative capable of esterification, and hydrophilic radicals are introduced therein as a copolymerization component to make the polyester soluble in water. The component having hydrophilic radicals include, for example, a component having sulfonate salt, diethylene glycol component, polyalkylene glycol component or polyalkylene glycol dicarbonate component, and preferable is an aromatic dicarboxylic acid having a sulfonate salt.

As the dibasic acid in the aforementioned hydrophilic polyester, can be used, for example, terephthalic acid, isophthalic acid, phthalic acid, phthalic anhydride, 2,6-naphthalene dicarboxylic acid, 1,5-naphthalene dicarboxylic acid, 1,4-naphthalene dicarboxylic acid, 2,7-naphthalene dicarboxylic acid, 1,4-cyclohexane dicarboxylic acid, adipic acid, sebacic acid, dimeric acid, maleic acid, fumaric acid and itaconic acid. The aforementioned dicarboxylic acid having a sulfonate salt more preferably containes a radical of an alkali-metal salt of sulfonic acid, such as alkali-metal salts of 4-sulfoisophthalic acid, 5-sulfoisophthalic acid, sulfoterephthalic acid, 4-sulfophthalic acid, 4-sulfonaphthalene-2,7-dicarboxylic acid and 5-(4-sulfenoxy)isophthalic acid, and specifically preferable thereof is sodium 5-sulfoisophthalate. The dicarboxylic acid having a sulfonate salt is preferably used within a range of 5 to 15 mol % based on total dicarboxylic acid component in respect to water solubility and water resistance, and specifically preferably within a range of 6 to 10 mol %.

The dicarboxylic acid component as a main component of hydrophilic polyester is preferably terephthalic acid and isophthalic acid. The ratio of terephthalic acid to isophthalic acid is specifically preferable 30/70 to. 70/30 by mole ratio in respect to the coating property to a polyester support and the solubility in water. The content of terephthalic acid and isophthalic acid is preferably 50 to 80 mol % based on the total dicarboxylic acid component, and further an alicyclic dicarboxylic acid as a copolymerization component may be incorporated. The alicyclic dicarboxylic acid includes, for example, 1,4-dicycloheane dicarboxylic acid, 1,3-dicycloheane dicarboxylic acid, 1,2-dicycloheane dicarboxylic acid, 1,3-cyclopentane dicarboxylic acid and 4,4'-bicyclohexyl dicarboxylic acid. The hydrophilic polyester of the invention which is composed of terephthalic acid and isophthalic acid as main dicarboxylic acid components may further contain a dicarboxylic acid as a copolymerization component other than the dicarboxylic acid described above. The carbonic acid for this purpose includes, for example, aromatic diarbonic acid and straight chain aliphatic dicarboxylic acid. The aromatic dicarboxylic acid is preferably used in a range of not more than 30 mol % based on the total dicarboxylic acid component. The aromatic dicarboxylic acid component for this purpose includes, for example, phthalic acid, 2,5-dimethylterephthalic acid, 2,6-naphthalene dicarboxylic acid, 1,4-naphthalene dicarboxylic acid and biphenyl dicarboxylic acid. The straight chain fatty dicarboxylic acid component can be used in a range of not more than 15 mol % based on the total dicarboxylic acid component. The straight chain fatty dicarboxylic acid component includes, for eaxample, adipic acid, pimelic acid, suberic acid, azelaic acid and sebacic acid.

The glycol component includes, for example, ethylene glycol, diethylene glycol, 1,3-propylene glycol, 1,4-butanediol, neopentyl glycol, dipropylene glycol, 1,6-hexanediol, 1,4-cyclohexane dimethanol, xylene glycol, polyethylene glycol (polyethyleneoxide glycol) and polytetramethyleneoxide glycol. The ethylene glycol as a glycol component of the hydrophilic polyester is preferably incorporated in a proportion of not less than 50 mol %, based on the total glycol component.

The hydrophilic polyester above-described can be synthesized using a dicarboxylic acid or its derivatives capable of ester formation and a glycol or its derivatives capable of ester formation, as starting materials. For the synthesis thereof can be used a variety of methods such as the preparation method of polyesters well known in the art, in which an initial condensation product of dicarboxylic acids and glycols is formed by an ester interchange method or a direct esterification method and is subjected to a melt polymerization. In more detail, the synthesis method includes, for example, a method in which an ester interchange reaction is performed between an ester of dicarboxylic acid, such as a dimethylester of the dicarboxylic acid, and the glycol, methanol is distilled, and then the pressure is gradually decreased to perform the polycondensation in high vacuo; a method in which an esterification reaction of the dicarboxylic acid and glycol is performed, water produced is distilled and then the pressure is gradually reduced to perform polycondensation in high vacuo; and a method in which an ester interchange reaction is performed between the dicarboxylic acid and the glycol, an esterification reaction further by adding a dicarboxylic acid is performed, and then the pressure is gradually reduced to perform the polycondensation in high vacuo. As an ester interchange catalyst and a polycondesation catalyst, those well known in the art can be used: examples of the ester interchange catalyst include manganese acetate, calcium acetate and zinc acetate, and examples of the polycondensation catalyst include antimony trioxide, germanium oxide, dibutyl tin oxide and titanium tetrabutoxide. However, various conditions such as the polymerization process and the catalyst are not limited to the examples above-mentioned.

As the hydrophilic polyester resin useful in the invention is more preferably used a hydrophilic polyester modified by a vinyl polymer. The hydrophilic polyester modified by a vinyl polymer can be obtained by dissolving in hot water an aqueous dispersion obtained by allowing a vinyl monomer to polymerize in aqueous hydrophilic polyester solution, or by dispersing a vinyl monomer in aqueous hydrophilic polyester solution to perform emulsion polymerization or suspension polymerization. The emulsion polymerization is more preferable. The structure of the modified hydrophilic polyester is not clear, however, it is supposed that the vinyl monomer may be grafted to the hydrophilic polyester while polymerization proceeds in the aqueous hydrophilic polyester solution.

The vinyl monomer includes acryl-type monomers, for example, alkyl acrylate, alkyl methacrylate (where the alkyl radical includes methyl, ethyl, n-propyl, isopropyl, n-butyl, isobutyl, t-butyl, 2-ethylhexyl, cyclohexyl, phenyl, benzyl and phenylethyl radicals); hydroxy-radical containing monomers such as 2-hydroxyethyl acrylate, 2-hydroxyethylmethacrylate, 2-hydroxypropyl acrylate and 2-hydroxypropyl methacrylate; amide-radical containing monomers such as acrylamide, methacrylamide, N-methyl methacrylamide, N-methyl acrylamide, N-methylol acrylamide, N-methylol methacrylamide, N,N-dimethylol acrylamide, N-methoxymethyl acrylamide, N-methoxy methacrylamide and N-phenyl acrylamide; amino-radical containing monomers such as N,N-diethyaminoethyl acrylate and N,N-diethylaminoethyl methacrylate; epoxy-radical containing acrylates such as glycidyl acrylate and glycidyl methacrylate; and monomers containing carboxy-radical or the salt thereof such as acrylic acid, methacrylic acid and the salts (sodium salt, potassium salt, ammonium salt, etc.) thereof. Further, the monomers other than acryl-type monomers include, for example; epoxy-radical containing monomers, acrylglycidyl ether; monomers containing sulfonic acid or the salts thereof such as stylenesulfonic acid, vinylsulfonic acid and the salts (sodium salt, potassium salt, ammonium salt, etc.) thereof; monomers containing a carboxyl-radical or the salts thereof such as crotonic acid, itaconic acid, maleic acid, fumaric acid and the salts thereof; monomers containing acid anhydride such.as maleic anhydride and itaconic anhydride; vinyl isocyanate, arylisocyanate, styrene, vinyltrisalkoxy silane, alkylmaleic monoester, alkylfumaric monoester, acrylonitrile, methacrylonitrile, alkylitaconic monoester, vinylidene chloride, vinyl acetate and vinyl chloride.

The amount of the vinyl-type monomer used is preferably within a range of 99/1 to 5/95, in terms of weight ratio of (hydrophilic polyester)/(vinyl monomer), more preferably 97/3 to 50/50, and specifically preferably 95/5 to 80/20.

An initiator is used for the polymerization of the vinyl monomers. Usable polymerization initiators include, for example, ammonium persulfate, potassium persulfate, sodium persulfate and benzoyl peroxide. Preferable thereof is ammonium persulfate. The polymerization can be performed without using a surfactant, however, a surfactant may be used as an emulsifier for the purpose of improving polymerization stability. In this case, any of commonly known nonionic or anionic surfactants can be used.

The undercoating layer used in the invention is prepared by coating an aqueous solution containing a hydrophilic polyester as an undercoating layer solution onto the polyester support. The undercoating layer solution may also contain a suitable amount of an aqueous-miscible organic solvent compatible with water. A surfactant may be added to the undercoating layer solution in order to enhance coatability. In addition thereto, there may optionally be added swelling agents for support, anti-crossover dyes, antihalation dyes, pigments, anti-fogging agents, antiseptic agents, plasticizers, cross-linking agents, dyes, etc. As the swelling agent, for example, phenol, resorcin, cresol and chlorophenol may be used. The addition amount thereof is preferably around 1 to 10 g/l, based on the undercoating layer solution.

The undercoating layer solution used in the invention can be coated by coating methods well known in the art to form the undercoating layer. The coating methods include, for example, dip coating, air-knife coating, curtain coating, roll coating, wired-bar coating, gravure coating, and extrusion coating by use of the a hopper described in U.S. Pat. No. 2,681,294. The methods for a simultaneous coating of two or more layers described in U.S. Pat. Nos. 2,761,791, 3,508,947, 2,941,898, 3,526,528 and p.235 of "Coating Technology" by Yuji Harazaki (published by Asakura-Shoten Co. in 1973) can be also preferably used.

The drying conditions of the undercoating layer according to the invention are preferably a temperature of 120 to 200° C. and a period of 10 sec. to 10 min.

The solids-coating amount of the undercoating layer according to the invention is preferably 0.01 to 10 g, and specifically preferably 0.05 to 3 g per $m^2$.

Prior to coating of the undercoating layer, the support may optionally be subjected a surface treatment well known in the art to enhance the adhesion, such as a chemical treatment (described in JP-B 34-11031, 38-22148, 40-2276, 41-16423 and 44-5116) (the term, JP-B refers to an examined and published Japanese Patent), a chemical and mechanical surface-roughening treatment (described in JP-B 47-19068 and 55-5104), a corona discharge treatment (described in JP-B 39-12838, JP-A 47-19824 and 48-28067) (the term, JP-A refers to an unexamined and published Japanese Patent Application), a flame treatment (described in JP-B 40-12384 and JP-A 48-85126), an ultraviolet radiation treatment (described in JP-B 36-18915, 37-14493, 43-2603, 43-2604 and 52-25726), an high-frequency treatment (described in JP-B 49-10687), a grow discharge treatment (described in JP-B 37-17682), an activated plasma treatment and a laser treatment. The contact angle between the support surface and water is preferably rendered by these treatments to levels of not more than 58°, as described in JP-B 57-487.

The undercoating layer according to the invention is preferably used specifically as the undercoating layer for the back-coating layer of the silver halide photothermographic materials.

The silver halide photothermographic light-sensitive layer according to the invention may be coated directly on a support without coating an undercoating layer. The layer may be also coated after the aforementioned treatments. In addition to the aforementioned treatments, a surface treatment for enhancing hydrophobicity of the support described in Japanese Patent Application 2000-066778 is preferably applied, in which the support surface is subjected to a gaseous discharge plasma treatment while the support being transported continuously in an atmosphere containing argon gas of not less than 50% by pressure, based on the introducing inert gas and a reactive gas composed of hydrocarbon and/or hydrocarbon fluoride, at atmospheric pressure or the vicinity thereof. Because the silver halide photothermographic light-sensitive layer is coated on the support using a hydrophobic resin and as a hydrophobic coating solution, the support surface is preferably subjected to the gaseous discharge plasma treatment at atmospheric pressure.

In the silver halide photothermographic material according to the invention, an organic solvent-based or water-based coating solution of the back-coating layer is coated on the undercoating layer of the opposite side of the support to the silver halide photothermographic light-sensitive layer. The back-coating layer may be composed of two or more layers.

The back-coating layer according to the invention contains a binder and variety of additives. As the binder of the back-coating layer is used generally a colorless natural or synthetic polymer compound which is transparent or translucent as a layer. The natural polymer compound includes, for example, gelatin, casein, gum arabic, alginic acid, starch, albumin, etc., and gelatin among these is preferably used. The synthetic polymer compound includes polyvinyl alcohol, hydroxyethyl cellulose, cellulose diacetate, cellulose acetate butylate, polyvinyl pyrrolidone, polyacrylic acid, polymethyl methacrylate, polymethacrylate, styrene-maleic anhydride copolymer, styrene-acrylonitrile copolymer, styrene-butadiene copolymer, polyvinyl acetals such as polyvinyl formal and polyvinyl butylal, polyesters, polyurethanes, phenoxy resins, polyvinyl chloride, polycarbonate, polyvinyl acetate, polyvinyl propionate, polyvinyl valerate, polyamides, etc. Among these are preferably used cellulose acetate butylate as a back-coating layer binder of solvent-base and polyvinyl alcohol and gelatin of water-base.

In the back-coating layer according to the invention, there may be further added, if necessary, surfactants, cross-linking agents, slipping agents, matting agents, etc. There may be also provided a backing resistive heating layer as described in U.S. Pat. Nos. 4,460,681 and 4,374,921.

The thickness of the back-coating layer of the silver halide photothermographic material according to the invention is preferably from 0.1 to 20 $\mu$m, and more preferably 0.5 to 10 $\mu$m.

In the silver halide photothermographic material according to the invention, there may be provided a protective layer onto the back-coating layer. The binder for the protective layer of the back-coating layer is not specifically limited, and the same binders as the aforementioned ones for the back-coating layer can be used. The solution of the protective layer or the back-coating layer is also either an organic solvent type or an aqueous type. The protective layer of the back-coating layer may also be incorporates with matting agents, dyes, slipping agents, surfactants, etc. The thickness of the protective layer of the back-coating layer is preferably 0.1 to 10 μm, and more preferably 0.5 to 5 μm.

Further, an embodiment of the silver halide photothermographic light-sensitive layer of the silver halide photothermographic material according to the invention will be described below.

The silver halide photothermographic material used in the invention is disclosed, for example, in such as U.S. Pat. Nos. 3,152,904, 3,457,075, "Dry Silver Photographic Material" by D. Morgan and p.278 of "Thermally Processed Silver Systems" by D. H. Klosterboer (Imaging Processes and Materials, Neblette 8th edition, edited by Sturge, V. Walworth and A. Shapp, in 1989).

The silver halide photothermographic material of the invention forms photographic images by heat development, and preferably comprises a reducible silver source (organic silver salt), a light-sensitive silver halide, a reducing agent and optionally a tone-modifying agent, which is generally dispersed in the binder to modify silver image tone. The silver halide photothermographic material of the invention is stable at ordinary temperature, and is developed by heating at a high temperature (for example, 80 to 140° C.) after exposure. Heating produces silver by the oxidation-reduction reaction between an organic silver salt (which functions as an oxidant) and a reducing agent. The oxidation-reduction reaction is accelerated by catalytic action of a latent image formed in the silver halide by an exposure. Silver formed by a reaction of the organic silver salt in the exposed region provides a black image, which is contrasted with the unexposed region, thereby forming images. The reaction process proceeds without supply of any processing solution such as water from the outside.

The light-sensitive silver halide grains function as a photo-sensor and the smaller mean grain size is preferred to depress the haze after the image formation and to achieve the superior image quality. The mean grain size is preferably not more than 0.1 μm, more preferably 0.01 to 0.1 μm, and still more preferably 0.02 to 0.08 μm. The mean grain size means the edge length of the silver halide grain in the case of so-called regular crystal grains, such as a cubic or octahedral grain. Further, it means the diameter of a sphere of an equivalent volume to the silver halide grain, in the case of non-regular crystal grains, such as spherical, rod-shaped or tabular grains. The silver halide is preferably monodisperse. The expression "monodisperse" means that the monodispersity defined in the following equation is not more than 40%, more preferably not more than 30%, and still more preferably 0.1 to 20%.

Monodispersity=(standard deviation of grain size)/(mean grain size)×100

The shape of the silver halide grains are not specifically limited, however, preferable to have a high proportion of Miller index [100] plane, and this proportion is preferably not less than 50%, more preferably not less than 70%, and specifically preferably not less than 80%. The proportion of Miller index [100] plane can be determined utilizing dependency of the adsorption onto [100] and [100] planes in the sensitizing dye adsorption behavior, as described in T. Tani, J. Imaging Sci., 29, 165 (1985).

Further, the other preferable shape of the silver halide is a tabular grain. The tabular grain means that the aspect ratio (r/h) is not less than 3, where r μm is the root of a projected area and h μm is the thickness in the vertical direction. Specifically preferable is the aspect ratio of 3 to 50. The grain size is preferably not more than 0.1 μm, and more preferably 0.01 to 0.08 μm. These are described in U.S. Pat. Nos. 5,264,337, 5,314,798 and 5,320,958, and the intended tabular grains can be easily obtained. When the tabular grains are used in the invention, the image sharpness is also enhanced. The halide composition is not specifically limited and any of silver chloride, silver chlorobromide, silver chloroiodobromide, silver bromide, silver iodobromide and silver iodide is usable.

The photographic emulsion used in the invention can be prepared by the methods described in such as "Chimie et Physique Photographique" by P. Glafkides (published by Paul Montel Co. in 1967), "Photographic Emulsion Chemistry" by G. F. Duffin (published by The Focal Press in 1966) and "Making and Coating Photographic Emulsion" by V. L. Zelikman et al (published by The Focal Press in 1964). The method may be either of acidic, neutral, or ammoniacal process, and the reaction between a soluble silver salt and a soluble halide may be any one of a single jet addition, simultaneous jet addition or the combination thereof. The silver halide may be added into the image-forming layer by any method, and is located in the neighborhood of the reducible silver source. Further, silver halide may be prepared by converting partially or completely an organic silver salt to silver halide through the reaction of the organic silver salt and a halide, by adding silver halide prepared previously into the solution for preparing the organic silver salt, or possibly by the combination method thereof. However, the second method is preferred. The silver halide incorporated is preferably 0.75 to 30% by weight based on the organic silver salt.

The silver halide used in the invention preferably contains transition metal ions belonging to the 6th to 11th group of the periodical table to improve the reciprocity law failure of illumination intensity or to control the contrast. Preferred examples of the metals described above include W, Fe, Co, Ni, Ca, Ru, Rh, Pd, Re, Os, Ir, Pt and Au. They may be incorporated into silver halide as a metal salt thereof as it is, however, can also be incorporated as a metal complex or a complex ion thereof. The transition metal complex or complex ion preferably is a six-coordinate complex or complex ion expressed by the following general formula:

General formula: $[ML_6]^m$ where M is a transition metal selected from the elements of the 6th to 11th group of the periodical table, L is a linking ligand and m is 0, 1-, 2-, 3- or 4-. Concrete examples of the ligand expressed by L include halogen (fluoride, chloride, bromide and iodide), cyanide, cyanato, thiocyanato, selenocyanato, tellurocyanato, ligands of azido and aquo, nitrocyl, thionitrocil, etc. When an aquo ligand is present, it is preferred to occupy one or two of the ligands. Plural L's can be of the same or different.

Specifically preferable examples of M are rhodium (Rh), ruthenium (Ru), rhenium (Re), iridium (Ir) and osmium (Os).

These metal complexes or complex ions may be of one kind, or of two or more kinds, which comprise of the same metal or the different ones.

These metal ions, metal complexes and complex ions are incorporated preferably in an amount of $1\times10^{-9}$ to $1\times10^{-2}$ mol, and more preferably $1\times10^{-8}$ to $1\times10^{-4}$ mol, based on 1 mol of silver halide. The compounds providing these metal ions or complex ions are preferably added during the formation of the silver halide grains so as to be occluded within the silver halide grains. They may be added at any stage of preparation of the silver halide grains, including before, during or after nucleation, growth, physical ripening and chemical ripening, specifically preferably at the stage of nucleation, growth or physical ripening, furthermore preferably at the stage of nucleation or growth, and most preferably at the stage of nucleation. They may be added a few times dividing to some fractions, and can be incorporated homogeneously within the silver halide grain, or with a distribution within the grain as described such as in JP-A63-26603, 2-306236, 3-167545, 4-76534, 6-110146 and 5-27683. These metal compounds can be added by being dissolved in water or suitable organic solvents (for example, alcohols, ethers, glycols, ketones, esters and amides), for example, by a method in which an aqueous solution of the powdered metal compound or that of the metal compound dissolved together with sodium chloride (NaCl) and potassium chloride (KCl) is previously added into a water soluble silver salt solution or into a water soluble halide solution; by a method in which the metal compounds are added as the third solution when the silver salt solution and halide solution are mixed to prepare the silver halide grains through triple-jet precipitation; by a method in which a required amount of an aqueous solution of the metal compound is added into the reaction vessel during the precipitation of grains; or by a method in which another silver halide grains previously doped with the metal ion or complex ion is added and dissolved during the precipitation of the silver halide grains. Specifically preferable is the method in which an aqueous solution of the powdered metal compound or that of the metal compound dissolved together with sodium chloride (NaCl) and potassium chloride (KCl) is added into the water soluble halide solution. When the metal complex is incorporated in the vicinity of the surface of the grain, a required amount of an aqueous solution of metal compounds can also be added into the reaction vessel immediately after completion of precipitation of grains, during or at the finish of physical ripening, or during chemical ripening.

The light-sensitive silver halide grains can be desalted by commonly known washing methods, such as noodle washing, flocculation method, etc., however, the desalting may be conducted or not.

The light-sensitive silver halide grains used in the invention are preferable to be chemically sensitized. As the preferable chemical sensitization method are usable a sulfur sensitization, a selenium sensitization, a tellurium sensitization, a noble metal sensitization using gold compounds, platinum, palladium, iridium, etc. and a reduction sensitization, which are well known in the art. As the compounds preferably used in the sulfur sensitization selenium sensitization and tellurium sensitization are usable the compounds well known in the art, and also the compounds described in JP-A 7-128768 can be used. Preferred examples of the compounds used in the noble metal sensitization include chloroauric acid, potassium chloroaurate, potassium aurothiocyanate, gold sulfide, gold selenide and the compounds described in U.S. Pat. No. 2,448,060 and British Patent 618061. The concrete compounds for the reduction sensitization are stanous chloride, aminoiminoethanesulfinic acid, hydrazine derivatives, borane compounds, silane compounds, polyamine compounds, etc. in addition to ascorbic acid, thiourea dioxide. Further, the reduction sensitization can be performed by ripening by keeping the emulsion at a pH of not lower than 7 or a pAg of not higher than 8.3 and also by introducing a single addition process of silver ion during the grain precipitation.

An organic silver salt used in the invention is a reducible silver source, and is preferably a silver salt of an organic acid and a heterorganic acid which include a reducible silver ion source, specifically preferably a long chain fatty carbonic acid (having carbon atoms of 10 to 30, preferably 15 to 25) and a nitrogen containing heterocyclic compound. Also useful are organic or inorganic silver complex salts whose ligands are capable of giving a total stability constant against silver ion of 4.0 to 10.0. Examples of suitable silver salts are described in Research Disclosure (hereinafter, also refers to RD) Nos. 17029 and 29963. The preferable silver source is silver behenate, silver arginate and/or silver stearate.

The organic silver salt is obtained by mixing a water soluble silver compound and a salt or a compound forming a complex with silver. A normal precipitation, reverse precipitation, double-jet precipitation and controlled double-jet method as described in JP-A 9-127643 are preferably used. For example, an organic silver salt crystal is prepared by preparing an organic alkaline metal salt soap (such as sodium behenate and sodium arginate) which is formed by adding an alkali metal salt (such as sodium hydroxide and potassium hydroxide) to an organic acid, followed by adding the aforementioned soap and silver nitrate by the controlled double-jet method. In this case, silver halide grains may concurrently be present in a mixture.

The organic silver salt according to the invention has a mean grain size of not more than 2 $\mu$m and is preferably monodisperse. The mean grain size means the diameter of a supposed sphere having an equivalent volume to the grains of organic silver salt when the grain is spherical, rod-shaped or tabular. The mean grain size is preferably 0.05 to 1.5 $\mu$m, and specifically preferably 0.05 to 1.0 $\mu$m. The expression "monodisperse" means the same as in the case of silver halide, and the monodispersity is preferably 1 to 30.

In the invention, not less than 60% of the total silver salt is preferably accounted for by tabular grains. The tabular grains in the invention refer to the grains having a ratio of the mean grain diameter to the thickness, so-called aspect ratio, expressed by the following equation (abbreviated as AR), of not less than 3.

$$AR = \text{mean grain diameter } (\mu\text{m})/\text{thickness } (\mu\text{m})$$

The organic silver salt of these shapes can be obtained by means of dispersing and grinding the aforementioned organic silver salt crystals with a binder and a surfactant by such as a ball mill. Such adjustment to this region results in a silver halide photothermographic material having a high density and superior image stability.

The total amount of the silver halide and organic silver salt is preferably 0.5 to 2.2 g per 1 $m^2$ based on silver to prevent the haze of the silver halide photothermographic material according to the invention. By setting in this region, high contrast images are obtained. The amount of silver halide based on the total amount of silver is not more than 50% by weight, preferably not more than 25%, furthermore preferably 0.1 to 15%.

The silver halide photothermographic material according to the invention preferably contains a reducing agent. Examples of preferable reducing agents are described in U.S. Pat. Nos. 3,770,448, 3,773,512, 3,593,863 and RD Nos.17029 and 29963. Specifically preferable reducing agents among them are bisphenols. The bisphenols include the compounds expressed by the following.general formula (A).

General formula (A)

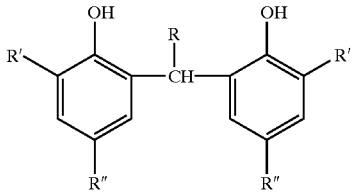

where R is a hydrogen atom or an alkyl radical having a carbon number of 1 to 10 (such as —$C_4H_9$ and 2,4,4-trimethylpentyl), R' and R" are each an alkyl radical having a carbon number of 1 to 5 (such as methyl, ethyl, t-butyl).

Concrete examples of the compound expressed by the general formula (A) are shown below. However, the present invention is not limited to the following compounds.

A-1

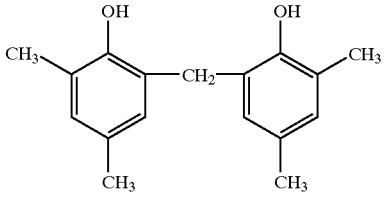

A-2

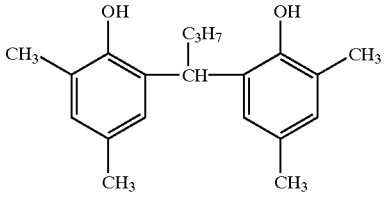

A-3

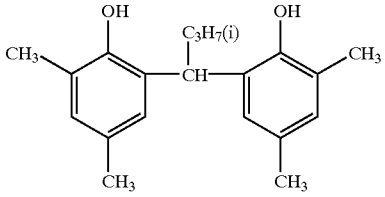

A-4

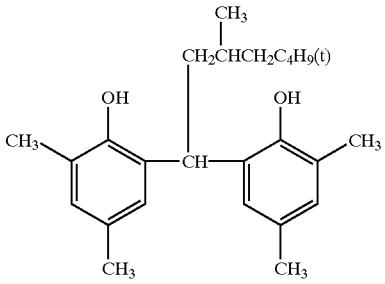

A-5

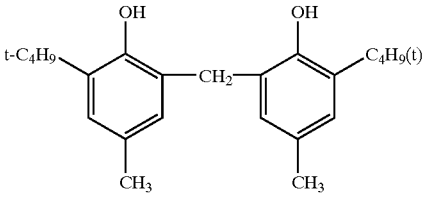

-continued

A-6

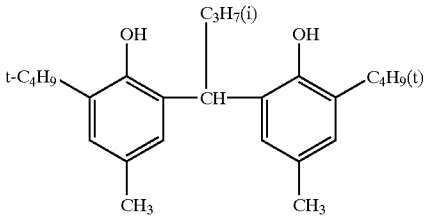

A-7

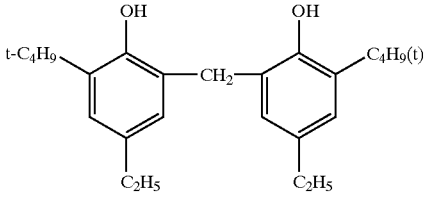

The using amount of the reducing agent represented by the general formula (A) described above is preferably $1\times10^{-2}$ to 10 mol based on 1 mol of silver, and specifically preferable is $1\times10^{-2}$ to 1.5 mol.

The preferable tone modofier used in the invention is disclosed in RD No.17029. The preferable color improver is phthalazinone or phthalazine. The tone modifier is used preferably in an amount of amount is preferably 0.0001 to 2 mol, based on 1 mol of the organic silver salt, and more preferably 0.0005 to 1 mol based on 1 mol of the organic silver salt.

Mercapto compounds, disulfide compounds and thione compounds can be incorporated into the light-sensitive layer to control the development by retarding or accelerating the development, to enhance the spectral sensitization efficiency, or to improve the storage stability of the photothermographic material before or after the development.

The mercapto compound is used in the silver halide photothermographic light-sensitive layer, and the preferable mercapto compounds are those represented by Ar—SM or Ar—S—S—Ar. In the formula, M is a hydrogen atom or alkali metal atom, and Ar is an aromatic ring or heterocyclic aromatic ring containing one or more nitrogen, sulfur, oxygen, selenium or tellurium atoms. The heterocyclic aromatic ring is preferably benzimidazole, naphthoimidazole, benzothiazole, naphthothiazole, benzoxathiazole, naphthoxazole, benzoselenazole, benzotellurazole, imidazole, oxazole, pyrazole, triazole, thiadiazole, tetrazole, triazine, pyrimidine, pyridazine, pyrazine, pyridine, purine, quinoline or quinazolinone. The heterocyclic aromatic ring may contain the substituent selected from the group constituted of, for example, halogen (such as Br and Cl), hydroxy, amino, carboxy, alkyl (for example, one containing one or more carbon atoms, and preferably 1 to 4 carbon atoms) and alkoxy (for example, one containing one or more carbon atoms, and preferably 1 to 4 carbon atoms).

The silver halide photothermographic material of the invention preferably contains an antifogging agent. Preferred antifogging agents are those described in U.S. Pat. No. 4,546,075, 4,452,885 and JP-A 59-57234. Specifically preferable is heterocyclic compounds having one or more substituent groups represented by —C ($X_1$) ($X_2$) ($X_3$) (where $X_1$ and $X_2$ is a halogen and $X_3$ is hydrogen or a halogen) such as described in U.S. Pat. Nos. 3,874,946 and 4,756,999. Examples of preferable antifogging agents are the compounds described in phrase Nos. [0030] to [0036] of JP-A 9-288328, and another preferable antifogging agents are the compounds described in phrase Nos. [0062] to

[0063] of JP-A 9-90550. Further, other preferable antifogging agents are disclosed in U.S. Pat. No. 5,028,523, European Patents 600587, 605981 and 631176.

In the silver halide photothermographic material of the invention, can be used the sensitizing dyes described, for example, in JP-A 63-159841, 60-140335, 63-231437, 63-259651, 63-304242, 63-15245, U.S. Pat. Nos. 4,639,414, 4,740,455, 4,741,966, 4,751,175 and 4,835,096. The preferable sensitizing dyes useful in the invention is described or referred to, for example, in item IV-A of RD No.17643 (p23, published in December 1978), item X of RD No.18431 (p437, published in August 1979). Specifically, sensitizing dyes having a spectral sensitivity suitable to the spectral characteristics of various scanner light sources can be usefully selected. For example, the compounds described in JP-A 9-34078, 9-54409 and 9-80679 are preferably used.

A binder usable in the silver halide photothermographic light-sensitive layer according to the invention is transparent or translucent, generally colorless, and there can be used natural polymer compounds or synthetic polymer compounds, which are similar to the binder of the back-coating layer described above. The binder may be hydrophilic or hydrophobic, and preferably is hydrophobic and transparent in the invention to reduce fogging caused after the heat development. Preferable binders include polyvinylbutylal, cellulose diacetate, cellulose acetate butylate, polyester resins, polycarbonate, polyacrylate and polyuretane resins. Are specifically preferably used among them, polyvinyl butylal, cellulose diacetate, cellulose acetate butylate, and polyester resins.

The silver halide photothermographic light-sensitive layer according to the invention may be comprised of plurality of layers, and the high-speed layer may be arranged under the low-speed layer or the low- speed layer may be arranged under the high-speed layer to control the contrast.

A light-insensitive protective layer is preferably provided over the silver halide photothermographic light-sensitive layer to protect the surface or prevent abrasion marks of the silver halide photothermographic material. The binder used in the non light-insensitive protective layer may be of the same kind as or different kind from those used in the photothermographic light-sensitive layer.

In the invention, the amount of the binder in the silver halide photothermographic light-sensitive layer is preferably 1.5 to 10 g/m$^2$ to accelerate the heat development, and more preferably 1.7 to 8 g/m$^2$ to accelerate the heat development. The mount less than 1.5 g/m$^2$ often increases markedly the fog density in the unexposed area to levels unacceptable in practical use.

In the invention, a matting agent is preferably incorporated in the layer on the side of the silver halide photothermographic light-sensitive layer to prevent causing flaws in images after the heat development. The matting agent is preferably incorporated in an amount of 0.5 to 30% by weight based on the total binder of the total layers on the side of the silver halide photothermographic light-sensitive layer. Further, the matting agent used in the side of the silver halide photothermographic light-sensitive layer is also incorporated preferably into the surface layer of the silver halide photothermographic material to control the slipping property and prevent finger prints, and, as described earlier, the similar matting agent is preferably incorporated also in the back-coating layer side in an amount of 0.5 to 40% by weight based on the total binder in the back-coating layer.

The matting agent used in the layer of the silver halide photothermographic light-sensitive layer side or of the back-coating layer side may be organic or inorganic material. Examples of the inorganic material include silica described in Swiss Patent 330158, glass powder described in French Patent 296995, and carbonate salts of alkaline earth metals, cadmium or zinc described in British Patent 1173181. Examples of the organic material include starch described in U.S. Pat. No. 2,322,037, starch derivatives described such as in Belgian Patent 625451 and British Patent 981198, polyvinyl alcohol described in JP-B 44-3643, polystyrene or polymethacrylate described in Swiss Patent 330158, polyacrylonitrile described in U.S. Pat. No. 3,079,257 and polycarbonate described in U.S. Pat. No. 3,022,169. The shape of the matting agent may be a regular form or irregular form, and preferably a regular and spherical form. The size of a matting agent is expressed by a diameter of a sphere having the volume equivalent to that of the matting agent particle. Thus, the size of the matting agent used in the invention refers to the sphere equivalent diameter. The average size of the matting agent is preferably 0.5 to 10 $\mu$m, and more preferably 1.0 to 8.0 $\mu$m. A coefficient of variation of particle size distribution is preferably not more than 50%, more preferably not more than 40%, and still more preferably not more than 30%. The adding method of the matting agent may be one in which the matting agent is dispersed in the coating solution in advance, or one in which the matting agent is sprayed after coating the coating solution and before completion of drying. In cases when a plurality of the matting agents are added, both methods may be used in combination.

Further, a filter dye layer and/or anti-halation dye layer may be provided on the side of the silver halide photothermographic light-sensitive layer to control the amount or the spectrum of light passing through the light-sensitive layer. Dyes and pigments may be included also in the silver halide photothermographic light-sensitive layer. The dyes used are any compound having the intended absorption within the desired wavelength region, and there are preferably used compounds described, for example, in JP-A 59-6481, 59-182436, U.S. Pat. Nos. 4,271,263, 4,594,312, European Patent 533008, 652473, JP-A 2-216140, 4-348339, 7-191432 and 7-301890.

The light-insensitive layers such as the protective layer, filter dye layer and anti-halation dye layer may contain lubricants such as a polysiloxane compound, wax and paraffin.

For example, surfactants, anti-oxidation agents, stabilizers, plasticizers, UV absorbents and coating aids may be used in the silver halide photothermographic material of the invention. As these additives and other additives described above, the compounds described in RD No.17029 (published in June 1978, pp.9 to 15) are preferably used.

Electric conductive compounds such as metal oxides and/or electroconductive polymer compounds can be incorporated into the component layers to improve the static charge buildup. These compounds may be incorporated in any of the component layers. As the electric conductive compounds are preferably used compounds described in col. 14 to 20 of U.S. Pat. No. 5,244,773.

The coating method of the necessary layers of the silver halide photothermographic material of the invention, such as a light-sensitive layer, a protective layer and a back-coating layer, is not specifically limited, and the methods well known in the art such as air-knife coating, dip-coating, bar coating, curtain coating and hopper coating can be used. Two or more of these layers may be coated simultaneously. As the organic solvent of the coating solution are preferably used methyl ethyl ketone, ethyl acetate, and toluene.

EXAMPLES

The invention will be concretely explained based on the examples below, however it is not limited to the examples.

Example 1

<Synthesis of Hydrophilic Polyester A-1>

Dimethyl terephthalate of 35.4 parts by weight, 33.63 parts by weight of dimethyl isophthalate, 17.92 parts by weight of sodium salt of dimethyl 5-sulfoisophthalate, 62 parts by weight of ethylene glycol, 0.065 parts by weight of calcium acetate, 0.022 parts by weight of manganese acetate tetrahydrate were charged into the vessel for condensation polymerization, and after an ester interchange reaction was performed under the atmosphere of a nitrogen flow at 170 to 220° C. while methanol was distilled, 0.04 parts by weight of trimethyl phosphate, 0.04 parts by weight of antimony trioxide and 6.8 parts by weight of 1,4-cyclohexane dicarbonate as condensation polymerization catalysts were added, and then an esterification was performed at a reaction temperature of 220 to 235° C. by distilling approximately a theoretical amount of water. Thereafter, the inside of the reaction system was evacuated in approximately an hour and heated, and finally subjected to a condensation polymerization at 280° C. and not more than 133 Pa for approximately an hour to obtain hydrophilic polyester A-1. The intrinsic viscosity of the hydrophilic polyester A-1 was 0.33.

<Preparation of Hydrophilic Polyester A-1 solution>

The foregoing hydrophilic polyester A-1 of 150 g was gradually added, while rotating the stirring blade, to the 2 lit. three-necked distillation flask equipped with a stirring blade, a reflux condenser and a thermometer, having been charged with 850 ml of pure water. After stirring was further continued for 30 min. at room temperature, the system was so heated that the internal temperature of the system was raised to 98° C. in 1.5 hrs., and the hydrophilic polyester was dissolved by heating for 3 hrs. at this temperature. After finishing the heating, the system was cooled down to room temperature, and kept for one night to prepare the hydrophilic polyester A-1 solution of 15% by weight.

<Preparation of Hydrophilic Polyester B-1 solution>

1900 ml of the above hydrophilic polyester A-1 was charged into the 3 l four-necked distillation flask, equipped with a stirring blade, a reflux condenser, a thermometer and a dropping funnel, and the system inside was heated up to 80° C. while rotating the stirring fun. Into this system was added 6.52 ml of aqueous 24% ammonium persulfate solution, then, a mixed solution of monomers (28.5 g of glycidyl methacrylate, 21.4 g of ethyl acrylate and 21.4 g of methyl methacrylate) was added drop-wise in 30 min., and the reaction was further continued for 3 hrs. Then, the system was cooled down to not more than 30° C. and filtered to prepare the modified hydrophilic polyester B-1 solution having 18% by weight solids.

<Synthesis of Acryl-type Polymer Latex C->

Pure water of 1900 ml was charged into the 3 lit. four-necked distillation flask, equipped with a stirring blade, a reflux condenser, a thermometer and a dropping funnel, and the system inside was heated up to 80° C. while rotating the stirring fun. Into this system was added 6.52 ml of aqueous 24% ammonium persulfate solution, a mixed solution of monomers (14.3 g of styrene, 28.5 g of glycidyl methacrylate and 26.5 g of n-butyl acrylate) was added drop-wise in 30 min., and the reaction was further continued for 3 hrs. Then, the system was cooled down to not more than 30° C. and filtered to prepare the acryl-type polymer latex C-1 having 30% by weight solids.

<Synthesis of Acryl-type Polymer Latex C-2>

Pure water of 1900 ml was charged into the 3 lit. four-neck distillation flask, equipped with a stirring blade, a reflux condenser, a thermometer and a dropping funnel, and the system inside was heated up to 80° C. while rotating the stirring blade. Into this system was added 6.52 ml of aqueous 24% ammonium persulfate solution, then, a mixed solution of monomers (19.3 g of stylen, 7.1 g of n-butyl acrylate, 25.0 g of t-butyl acrylate and 20.0 g of hydroxy methacrylate) was added drop-wise in 30 min., and the reaction was further continued for 3 hrs. Then, the system was cooled down to not more than 30° C. and filtered to prepare the acryl-type polymer latex C-2 having 30% by weight solids.

<Preparation of Fine Particles in the Undercoating Layer>

As the fine particles, various kinds of matting agents available on the market were prepared, classified, further measured or examined with respect to average particle size, variation coefficient of particle size distribution, $r_2/r_1$, porosity, and the presence of an alcohol treatment to obtained fine particles. Nos. 1 to 12 of Table 1, which were each added to the upper undercoating layer.

<Preparation of Coating Solution of Undercoating Layer>

Coating solution of lower undercoating layer b-1

| | |
|---|---|
| Acryl-type polymer latex C-1 (30% solid) | 25 g |
| Acryl-type polymer latex C-2 (30% solid) | 6.4 g |
| $SnO_2$ sol (10% solid) | 154 g |
| Surfactant (A) | 0.5 g |

Distilled water was added to make 1000 ml coating solution.

The $SnO_2$ sol was one synthesized by the method described in JP-A 10-59720.

Coating Solution of the Upper Undercoating Layer B-2

| | |
|---|---|
| Modified hydrophilic polyester B-1 (18% solid) | 56.0 g |
| Surfactant (A) | 0.1 g |
| Fine particles of Table 1 | 0.3 g |

Distilled water was added to make 1000 ml coating solution.

Surfactant (A)

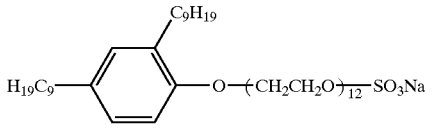

Preparation of Support with Undercoating Layer

One side of the number of biaxially stretched polyethylene terephthalate film sheets (produced by Konica Corp., 175 μm thick, 1000 m long, and blueotinted), corresponding to the kind of matting agent and the kind of the support surface of the light-sensitive layer side described in Table 1 was subjected to a corona discharge treatment at the condition of 12 $W/m^2$·min, the lower undercoating layer solution b-1 described above thereon was coated thereon so as to have a dry thickness of 0.10 μm, and dried at 140° C., subsequently, the upper undercoating layer solution b-2 was coated so as to have a dry thickness of 0.05 μm, and then the films were dried at 140° C. while being transported by guide rolls. The films were further thermally treated at 125° C. for 2 min. while further being transported by guide rolls, cooled to room temperature, and the thus prepared films were each wound up to obtain supports coated with the different kinds of the undercoating layer as shown in Table 1.

<Measurement of Number of Fine Particles in Upper Undercoating Layer>

The samples coated with the upper undercoating layer were cut out, and the number of fine particles in an area of 100 μms square was counted through an optical microscope.

<Measurement of Center-line Mean Roughness (Ra) of Upper Undercoating Layer>

The center-line mean roughness of the surface of the upper undercoating layer was measured by the use of WYKO TOPO-3D (produced by WYKO Co.).

The obtained results above about the center-line mean roughness and the number of fine particles are shown in following Table 1.

TABLE 1

| | Fine particles | | | | | | | | | |
|---|---|---|---|---|---|---|---|---|---|---|
| No. | Material | Adding amount (g) | r2/r1 | Mean primary diameter (μm) | Variation coefficient of primary particle size | Presence of alkoxide | porosity | center-line mean roughness (Ra) | number of particles per 100 $\mu m^2$ | Remarks |
| 1 | silica | 0.08 | 3.0 | 5.5 | 1.65 | present | porous | 112 | 3 | Comp. |
| 2 | silica | 0.2 | 2.6 | 2.5 | 1.31 | present | Non-porous | 50 | 8 | Comp. |
| 3 | silica | 0.1 | 1.9 | 2.0 | 1.50 | present | Non-porous | 37 | 7 | Comp. |
| 4 | silica | 0.3 | 1.5 | 1.6 | 0.23 | absent | Non-porous | 35 | 15 | Comp. |
| 5 | silica | 0.3 | 1.2 | 2.0 | 0.23 | present | Non-porous | 40 | 10 | Comp. |
| 6 | silica | 0.6 | 1.3 | 1.1 | 0.20 | present | porous | 12 | 53 | Inv. |
| 7 | silica | 0.3 | 1.3 | 0.8 | 0.22 | present | Non-porous | 11 | 20 | Inv. |
| 8 | silica | 0.3 | 1.3 | 0.8 | 0.24 | present | porous | 13 | 22 | Inv. |
| 9 | silica | 0.3 | 1.2 | 0.7 | 0.19 | absent | Non-porous | 9 | 28 | Inv. |
| 10 | silica | 0.3 | 1.3 | 0.6 | 0.15 | present | Non-porous | 10 | 35 | Inv. |
| 11 | silica | 0.3 | 1.1 | 0.5 | 0.18 | present | Non-porous | 10 | 40 | Inv. |
| 12 | silica | 0.3 | 1.3 | 0.5 | 0.11 | present | porous | 10 | 43 | Inv. |

Evaluation

<Evaluation of Abrasion Mark>

The test for abrasion mark on the surface of the undercoating layer (test surface) of the support coated with the upper and lower undercoating layers was conducted according to the following procedure to evaluate the degree of appearance of abrasion marks.

The samples were cut to a size of 15 cm long and 6 cm wide, and after being kept under an atmosphere of 23° C. and 55% RH for 24 hrs., a weight with a sheet of black woolen cloth attached to the bottom surface was placed on the test surface, the weight was pulled along the test surface. The sample surface was observed through an optical microscope at the position or in the neighborhood thereof at the time when the friction coefficient showed the maximum value, and evaluated with respect to number of abrasion marks of not less than 100 μm long in the direction of abrasion, based on the following rank:

Rank 5: no marks

Rank 4: 1 to 5 marks

Rank 3: 6 to 15 marks

Rank 2: 16 to 40 marks

Rank 1: 41 or more marks.

The black woolen cloth was replaced for each test. The results are shown in Table 2.

<Preparation of Coating Solution of Back-coating Layer>

To 830 g of methyl ethyl ketone, 84.2 g of CAB381-20 (cellulose acetatebutylate, produced by Eastman Chemical Co.) and 4.5 g of Vitel-PE2200B (polyester resin, roduced by Bostic Co.) were added with stirring and.dissolved. Further thereto were added 0.30 g of Infrared Dye-1, then, 4.5 g of Surlon-KH40 (fluorine surfactant, produced by Asahi Glass Co., Ltd.) was dissolved in 43.2 g of methanol and 2.3 g of Megafag-F120K (fluorine surfactant, produced by Dainippon Ink Corp.) was added, and the solution was stirred sufficiently until they were completely dissolved. Finally, 75 g of a dispersion of a silica (Siloid-64X6000, produced by W.R. Grace Co.), which was dispersed in methyl ethyl ketone by a dissolver-type homogenizer with a concentration of 1% by weight was added thereto and the solution was stirred to prepare the coating solution of the back-coating layer.

Infrared Dye-1

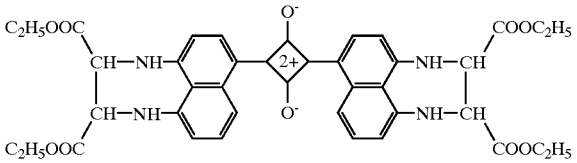

The back-coating layer coating solution was coated on the upper undercoating layer of the support by an extrusion coater so as to have a dry layer thickness of 3.5 μm and dried with a hot air at a dry-bulb temperature of 100° C. and a dew point of 10° C. for 5 min., and the thus prepared film support was wound up.

<Coating of Silver Halide Light-sensitive Layer>

The surface of the light-sensitive layer side (the opposite surface to the back-coating layer) of the support was kept as a polyethylene terephthalate surface, without subjecting any treatment or coating any undercoating layer and the silver halide photothermographic light-sensitive layer was directly coated on this surface.

<Preparation of Coating Solution of Silver Halide Photothermographic Light-sensitive Layer>

Preparation of Light-sensitive Silver Halide Emulsion A

| | |
|---|---|
| Solution A1: | |
| Phenylcarbamoyl gelatin | 88.3 g |
| $HO(CH_2CH_2O)_n$—$(CH(CH_2)_3)CH_2O)_{17}$—$(CH_2(CH_2)CH_2O)_mH$ (m + n = 5 to 7) (10% methanol solution) | 10 ml |
| Potassium bromide | 0.32 g |
| Water to make 5429 | |
| Solution B1: | |
| 0.67 mol/l silver nitrate aqueous solution | 2635 ml |
| Solution C1: | |
| Potassium bromide | 51.55 g |
| Potassium iodide | 1.47 g |
| Water to make 660 ml | |
| Solution D1: | |
| Potassium bromide | 154.9 g |
| Potassium iodide | 4.41 g |
| Iridium chloride (1% aqueous solution) | 0.93 ml |
| Water to make 1982 ml | |
| Solution E1: | |
| 0.4 mol/l aqueous potassium bromide solution | |
| an amount necessary to control the silver potential | |
| Solution F1: | |
| Potassium hydroxide | 0.71 g |
| Water to make 20 ml | |
| Solution G1: | |
| 56% aqueous acetic acid solution | 18.0 ml |
| Solution H1: | |
| Sodium carbonate anhydride | 1.72 g |
| Water to make 151 ml | |

A nucleation was performed by adding ¼ volume of Solution B1 and the total volume of Solution C1 to solution A1, while controlling the temperature at 45° C. and pAg at 8.09, in 4 min and 45 sec. according to a double-jet precipitation using a mixing stirrer described in JP-B 58-58228. After 1 min., the total volume of Solution F1 was added. Meanwhile, the pAg was suitably controlled by use of Solution E1. After 6 min., ¾ volume of Solution B1 and the total volume of solution D1 were added with controlling the temperature at 45° C. and pAg at 8.09 in 14 min and 15 sec. according to the double-jet precipitation method. After further stirring for 5 min., the temperature was lowered to 40° C., the total of Solution G1 was added, and the silver halide emulsion was sedimented. The supernatant solution was discharged leaving 2000 ml of the sediment part, 10 1 of water was added, after being stirred the silver halide emulsion was sedimented again. The supernatant solution was discharged leaving 1500 ml of the sediment part, further, 10 l of water was added, after being stirred the silver halide emulsion was sedimented. After discharging the supernatant solution to leave 1500 ml of the sediment part, Solution H1 was added, the temperature was raised up to 60° C., and the emulsion was further stirred for 120 min. Finally, the pH was adjusted to 5.8, water was added to make the amount of water to be 1161 g per 1 mol of silver, and light-sensitive silver halide emulsion A was thus obtained.

The light-sensitive silver halide emulsion A was comprised of monodisperse cubic silver iodobromide grains having a mean grain size of 0.058 μm, a coefficient of variation of grain size of 12% and a [100] surface proportion of 92%.

<Preparation of Powdered Organic Silver Salt A> behenic acid of 130.8 g, 67.7 g of arachidic acid, 43.6 g of stearic acid and 2.3 g of palmitic acid were dissolved in 4720 ml of pure water. Then, 540.2 ml of 1.5 mol/l sodium hydroxide aqueous solution was added, and after adding 6.9 ml of concentrated nitric acid, the solution was cooled down to 55° C. to obtain a solution of sodium salt of fatty acid. Keeping the temperature of the fatty acid sodium salt solution at 55° C., 45.3 g of light-sensitive silver halide emulsion A and 450 ml of pure water was added thereto and the solution was stirred for 5 min.

Next, 702.6 ml of 1 mol/l silver nitrate solution was added in 2 min. and the solution was stirred for 10 min. to obtain a dispersion of organic silver salt. Thereafter, the obtained dispersion of organic silver salt was transferred into a washing vessel, and after being stirred with an addition of deionized water, the solution was allowed to stand to perform floatation of an organic silver salt dispersion and the underlying soluble salt was removed. Then, washing with deionized water and discharging were repeated until the conductivity of the waste water reached 2 μS/cm, and after being subjected to centrifugal dehydration, the obtained organic silver salt cake was dried until the moisture content reached 0.1%, by the use of an air flowing-type drier "Flash Jet Drier (produced by Seishin-Kigyo Co., Ltd.)" in an nitrogen gas atmosphere under the control of operation conditions of gas temperature at the inlet of the drier to obtain dried powdery organic silver salt A. Herein, an infrared aquameter was employed to determine the moisture content of the organic silver salt composition.

<Preparation of Preliminary Dispersion Solution A>

Powdery 14.57 g polyvinyl butyral (Butvar B-79, produced by Monsanto Co., Ltd.) was dissolved in 1457 g of methyl ethyl ketone, subsequently, 500 g of the powdery organic silver salt A was gradually added with stirring by a dissolver "DISPERMAT CA-40M" (produced by VMA-GETZMANN Co.), and the solution was mixed throughly to obtain the preliminary dispersion solution A.

<Preparation of Light-sensitive Emulsion Dispersion Solution>

Preliminary dispersion solution A, as obtained above was supplied to a media-type disperser "DISPERMAT SL-C12EX (produced by VM-GETZMANN Co.), 80% of the capacity thereof being filled with zirconia beads having a diameter of 0.5 mm (TORESELAM, produced by Toray Corp.), and dispersed at a mill circumferential speed of 8 m/s and for 1.5 min. of a retention time to prepare the light-sensitive emulsion dispersion solution.

<Preparation of Stabilizer Solution>

Stabilizer-1 of 1.0 g and 0.13 g of potassium acetate were dissolved in 4.97 g of methanol to prepare the stabilizer solution.

<Preparation of Infrared Sensitizing Dye Solution A>

Infrared sensitizing dye-1 of 19.2 mg, 1.488 g of 2-chloro benzoic acid, 2.779 g of Stabilizer-2 and 365 mg of 5-metyl-2-mercaptobenzimidazole were dissolved in 31.3 ml of methyl ethyl ketone in the dark to prepare the infrared sensitizing dye solution A.

Stabilizer-1

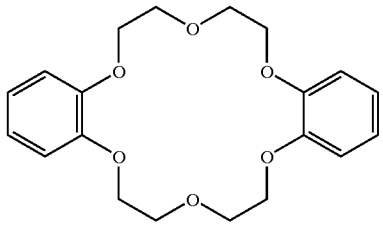

Infrared sensitizing dye-1

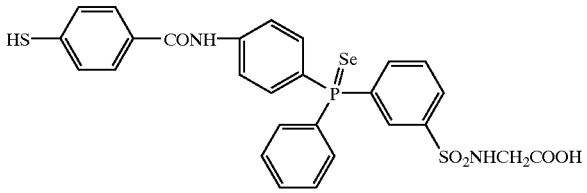

Stabilizer-2

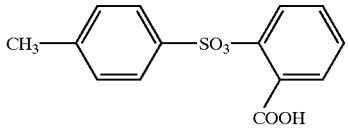

<Preparation of Additive Solution a>

In 110 g of methyl ethyl ketone, 27.98 g of 1,1-bis(2-hydroxy-3,5-dimethylphenyl)-2-methylpropane as a developer, 1.54 g of methyl phthalic acid and 0.48 g of Infrared sensitizing dye-1 above described were dissolved to prepare the additive solution a.

<Preparation of Additive Solution b>

In 40.9 g of methyl ethyl ketone, 3.56 g of Anti-fogging agent-2 and 3.43 g of phthalazine were dissolved in 40.9 g of methyl ethyl ketone to prepare the additive solution b.

Anti-fogging agent-2

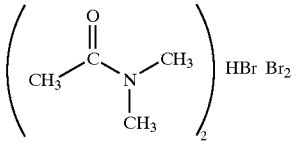

<Preparation of Light-sensitive Layer Coating Solution >

Under the atmosphere of an inert gas (97% nitrogen), 50 g of the foregoing light-sensitive emulsion dispersion solution and 15.11 g of methyl ethyl ketone were kept at a temperature of 21° C. with stirring, 1000 μl of S-5 (chemical sensitizer, 0.5% methanol solution) was added thereto, and after 2 min., 390 μl of Anti-fogging agent-1 (10% methanol solution) was added, and the solution was stirred for 1 hr. Further, after adding 494 μl of calcium bromide (10% methanol solution) and stirring for 10 min., 1/20 equivalent mol, based on the foregoing S-5, of Au-5 (gold sensitizer) was added, and the solution was stirred for further 20 min. Then, after adding 167 ml of Stabilizer solution above described and stirring for 10 min., 1.32 g of Infrared sensitizing dye solution A was added and the solution was stirred for 1 hr. While keeping the solution at 13° C., after adding 13.31 g of polyvinyl butyral (Butvar B-79, produced by Monsanto Co.) and stirring for 30 min., 1.084 g of tetrachlorophthalic acid (9.4% by weight methyl ethyl ketone solution) was added and the solution was stirred for 15 min. While keeping the stirring, 12.43 g of Additive solution-a described above, 1.6 ml of "Desmodur N3300" (10% methyl ethyl ketone solution of fatty acid isocyanate, produced by Movey Co.) and 4.27 g of Additive solution-b were added in order, and the solution was stirred to prepare the coating solution of the silver halide photothermographic light-sensitive layer.

S-5

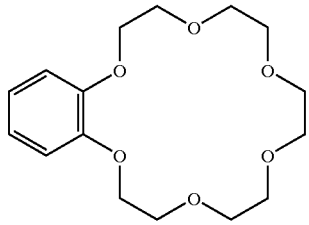

Au-5

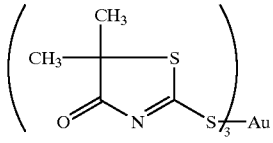

Anti-fogging agent-1

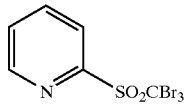

<Preparation of Coating Solution of Surface Protective Layer>

Preparation of Matting Agent Solution

In 42.5 g of methyl ethyl ketone, 7.5 g of cellulose acetate butylate (CAB 171-15, produced by Eastman Chemical Co.) was dissolved, then, potassium carbonate (Super-Pflex200, produced by Speciality Minerals Co.) was added thereto, and the solution was dispersed for 30 min. at 8000 rpm with a dissolver-type homogenizer to prepare the dispersion solution of a matting agent.

<Preparation of Coating Solution of Surface Protective Layer>

To 865 g of methyl ethyl ketone, 96 g of cellulose acetate butylate (CAB 171-15, produced by Eastman Chemical Co.), 4.5 g of polymethyl methacrylate (Paraloide A-21, produced by Rhom & Haas Co.), 1.5 g of VSC (vinylsulfon compound), 1.0 g of benztriazole and 1.0 g of Surfron KH40 (frorine surfactant, produced by Asahi Glass Co.) were added with stirring and dissolved. Then, the dispersion solution of matting agent above described was added and stirred to prepare the coating solution of the surface protective layer.

VSC

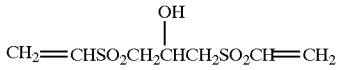

<Coating of Silver Halide Light-sensitive Layer and Surface Protective Layer>

The coating solution of the silver halide photothermographic light-sensitive layer and the coating solution of the surface protective layer were simultaneously coated, on the light sensitive layer side of the support having been coated with a back-coating layer, by the use of an extrusion coater, to prepare a silver halide photothermographic light-sensitive material sample. Coating was performed to have a silver coverage of 1.9 g/m$^2$ of the silver halide photothermographic light-sensitive layer and a dry layer thickness of 2.5 $\mu$m of the surface protective layer. Then, the coated sample was dried with a drying air at a dry-bulb temperature of 75° C. and a dew point of 10° C., for 10 min.

Evaluation

Evaluation of White Spot Defect

First, the following exposure and heat development were performed on each sample. Exposure and heat development were carried out in the room conditioned at 23° C. and 50% RH, and the exposure was made using a semiconductor laser imager having a semiconductor laser of an emission wavelength of 810 nm. Thereafter, the heat development was made using an automatic developer equipped with a heating drum, at 110° C. for 15 sec. The exposed area of the thus thermally developed sample was visually observed through an optical microscope and the number of white spots present in an area of 10 m$^2$ was counted, where the white spot means the spot-like defect having a diameter of 0.5 to 3 mm and an optical density lower than the surrounding portion, and the number of white spots exhibiting a marked difference in optical density was also counted to evaluate.the sample according to the following criteria:

Rank 5: no spots was observed

Rank 4: one white spot having an optical density difference from the surrounding of not more than 0.05 was observed, Rank 3: 2 to 3 white spots having an optical difference from the surrounding of not more than 0.05 were observed, Rank 2: many white spots having an optical density difference from the surrounding of not less than 0.06 were observed, and Rank 1: Many white spots having an optical density difference from the surrounding of not less than 0.1 were observed.

The results are shown in Table 2.

TABLE 2

| Sample No. | Abrasion mark (rank) | Whitish spot (rank) | Remarks |
|---|---|---|---|
| 1 | 1 | 1 | Comparative |
| 2 | 2 | 1 | Comparative |
| 3 | 2 | 2 | Comparative |
| 4 | 2 | 2 | Comparative |
| 5 | 3 | 3 | Comparative |
| 6 | 5 | 5 | Invention |
| 7 | 5 | 5 | Invention |
| 8 | 4 | 4 | Invention |
| 9 | 5 | 5 | Invention |
| 10 | 5 | 5 | Invention |
| 11 | 5 | 5 | Invention |
| 12 | 4 | 4 | Invention |

As can be seen from Table 2, it was proved that the silver halide photothermographic material samples according to the invention had minimized abrasion marks produced, e.g., during the transportation of the samples having been coated with the upper undercoating layer, and almost no white spot defect was observed. On the contrary, it was proved that, in the comparative sample using large fine particles, some fine particles were collapsed, thereby producing pores in the undercoating layer and resulting in marked abrasion marks, and many white spot defects were also produced.

The present invention provides the silver halide photothermographic light-sensitive material, without defects causing misdiagnosis, having superior resistance against abrasion marks, and presenting few white spot defects even under the high temperature treatment of the heat development.

What is claimed is:

1. An silver halide photothermographic light sensitive material comprising a support having thereon a undercoating layer and a photothermographic light-sensitive layer containing a light-sensitive silver halide, and organic silver salt, a reducing agent and a binder, wherein the undercoating layer contains fine particles having a mean primary particle size of 0.01 to 1.6 $\mu$m and satisfying the following equation, $$1 \leqq (r2/r1) \leqq 1.4$$

wherein $r_1$ and $r_2$ are respectively an inscribed circle radius and a circumscribed circle radius of each of projected images of the fine particles obtained by a microscope, and $(r_2/r_1)$ is an average value of $r_2/r_1$ of projected images of 500 fine particles randomly selected from the whole fine particles.

2. The silver halide photothermographic light-sensitive material of claim 1, wherein the undercoating layer contains the fine particles of 10 to 100 in an area of 100 $\mu$m square and has a center-line mean roughness (Ra) of not more than 0.015 nm.

3. The silver halide photothermographic light-sensitive material of claim 1, wherein the fine particles have a variation coefficient of primary particle size of not more than 0.25.

4. The silver halide photothermographic light-sensitive material of claim 1, wherein the fine particles are inorganic fine particles having a surface modified with an alkoxide.

5. The silver halide photothermographic light-sensitive material of claim 1, wherein the fine particles are non porous.

6. The silver halide photothermographic light-sensitive material of claim 1, wherein the undercoating layer contains a hydrophilic polyester resin.

* * * * *